US012788063B2

(12) United States Patent
Chen

(10) Patent No.: US 12,788,063 B2
(45) Date of Patent: Nov. 10, 2026

(54) HEATING ATOMIZATION CORE, HEATING ATOMIZATION MECHANISM, HEATING ATOMIZER, AND ELECTRONIC ATOMIZATION DEVICE

(71) Applicant: SHENZHEN HUACHENGDA PRECISION INDUSTRY CO. LTD., Shenzhen (CN)

(72) Inventor: Ping Chen, Shenzhen (CN)

(73) Assignee: SHENZHEN HUACHENGDA PRECISION INDUSTRY CO. LTD., Shenzhen (CN)

( * ) Notice: Subject to any disclaimer, the term of this patent is extended or adjusted under 35 U.S.C. 154(b) by 407 days.

(21) Appl. No.: 18/572,197

(22) PCT Filed: Aug. 18, 2021

(86) PCT No.: PCT/CN2021/113355
§ 371 (c)(1),
(2) Date: Dec. 20, 2023

(87) PCT Pub. No.: WO2023/019486
PCT Pub. Date: Feb. 23, 2023

(65) Prior Publication Data

US 2024/0365867 A1 Nov. 7, 2024

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/46* (2020.01); *A24F 40/485* (2020.01)

(58) Field of Classification Search
CPC ..... A24F 40/40; A24F 40/44
See application file for complete search history.

(56) References Cited

U.S. PATENT DOCUMENTS

2018/0325178 A1* 11/2018 Zhao ..... A24F 40/46
2019/0053539 A1 2/2019 Sebastian
(Continued)

FOREIGN PATENT DOCUMENTS

CN 203168034 U * 9/2013
CN 104970444 A 10/2015
(Continued)

OTHER PUBLICATIONS

English machine translation of CN110150765 (Year: 2019).*
(Continued)

*Primary Examiner* — Robert C Dye
(74) *Attorney, Agent, or Firm* — Andrew C. Cheng

(57) ABSTRACT

A heating atomization core comprises an atomization core housing, a liquid transfer unit, a heating element and a fixing member, wherein the heating element is attached to an inner wall of the liquid transfer unit, and a liquid transfer hole is formed in a side wall of the atomization core housing. Liquid transfer cloth comprises at least two layers of vertical-grain liquid transfer cloth, or at least two layers of horizontal-grain liquid transfer cloth, or at least one layer of vertical-grain liquid transfer cloth and at least one layer of horizontal-grain liquid transfer cloth. Grains on the vertical-grain liquid transfer cloth form micro-grooves which are arranged vertically. Grains on the horizontal-grain liquid transfer cloth form micro-grooves which are arranged horizontally. This can make the liquid enter the liquid transfer unit more uniformly, and the liquid transfer efficiency and atomization effect are improved.

20 Claims, 12 Drawing Sheets

(51) Int. Cl.
*A24F 40/46* (2020.01)
*A24F 40/485* (2020.01)

(56) References Cited

U.S. PATENT DOCUMENTS

| | | | | |
|---|---|---|---|---|
| 2019/0350258 | A1* | 11/2019 | Xiao | A24F 40/40 |
| 2020/0060344 | A1 | 2/2020 | Tan | |
| 2022/0295876 | A1 | 9/2022 | Zhou | |

FOREIGN PATENT DOCUMENTS

| | | | | | |
|---|---|---|---|---|---|
| CN | 110150765 | A | * | 8/2019 | A24F 47/004 |
| CN | 209498589 | U | | 10/2019 | |
| CN | 111109664 | A | | 5/2020 | |
| CN | 210782910 | U | | 6/2020 | |
| CN | 210841581 | U | | 6/2020 | |
| CN | 211431092 | U | | 9/2020 | |
| CN | 111920102 | A | * | 11/2020 | A24F 40/46 |
| CN | 112137171 | A | | 12/2020 | |
| EP | 2413863 | B1 | | 8/2018 | |
| EP | 3510880 | A1 | | 7/2019 | |
| JP | 3001285 | U | | 8/1994 | |
| JP | 2009276034 | A | | 11/2009 | |
| JP | 2019528735 | A | | 10/2019 | |
| JP | 2021106593 | A | | 7/2021 | |
| WO | 2012002296 | A1 | | 1/2012 | |
| WO | 2014106329 | A1 | | 7/2014 | |
| WO | 2018170849 | A1 | | 9/2018 | |
| WO | 2018176344 | A1 | | 10/2018 | |

OTHER PUBLICATIONS

English machine translation of CN111920102 (Year: 2020).*
English machine translation of CN203168034 (Year: 2013).*
International Search Report of PCT Patent Application No. PCT/CN2021/113355 issued on May 5, 2022.

* cited by examiner

HEATING ATOMIZATION CORE, HEATING ATOMIZATION MECHANISM, HEATING ATOMIZER, AND ELECTRONIC ATOMIZATION DEVICE

FIELD

The invention relates to the technical field of atomization, and particularly relates to a heating atomization core, a heating atomization mechanism, a heating atomizer, and an electronic atomization device.

BACKGROUND

In the prior art, a heating atomization core typically comprises a liquid transfer unit and a heating element, liquid in a liquid chamber enters the liquid transfer unit and is then transferred to the heating element. The heating element generates heat to atomize cigarette liquid into steam. Existing liquid transfer units cannot allow liquid to flow therein uniformly or transfer liquid uniformly, and cannot supply sufficient liquid to the heating element. When the heating element operates continuously, the liquid transfer unit cannot give the heating element enough cigarette liquid, making the atomization effect unsatisfying and severely compromising the inhaling experience of users.

SUMMARY

The technical issue to be settled by the invention is to overcome the defects of non-uniform liquid inflow and transfer, low liquid transfer rate and unsatisfying atomization effect in the prior art by providing a heating atomization core, a heating atomization mechanism, a heating atomizer, and an electronic atomization device having a good atomization effect and a high liquid transfer rate.

The technical solution that the present invention adopts to resolve the technical problems is to develop a heating atomization core which comprises an atomization core housing. A cylindrical liquid transfer unit is arranged in the atomization core housing, and a heating element is attached to an inner wall of the liquid transfer unit and is connected to an electrode.

A liquid transfer hole for transferring liquid into the liquid transfer unit is formed in a side wall of the atomization core housing.

The liquid transfer unit is a cylindrical structure formed by rolling multiple layers of liquid transfer cloth in a stacked manner. The multiple layers of liquid transfer cloth comprise at least one layer of vertical-grain liquid transfer cloth or/and at least one layer of horizontal-grain liquid transfer cloth, the vertical-grain liquid transfer cloth has micro-grooves or/and micro-ridges formed by grains which are arranged vertically on the whole, and the horizontal-grain liquid transfer cloth has micro-grooves or/and micro-ridges formed by grains which are arranged horizontally on the whole.

A fixing member for fixing the electrode is arranged in the atomization core housing below the liquid transfer unit, and an air inlet is formed in the fixing member.

Preferably, 1-6 layers of vertical-grain liquid transfer cloth are arranged, and at least part of the grains on each of the layers of vertical-grain liquid transfer cloth correspond to each other in a radial direction, such that a heating circuit of the heating element is at least partially inlaid in the micro-grooves or between the adjacent micro-ridges formed by the grains.

Preferably, the grains on the vertical-grain liquid transfer cloth and on the horizontal-grain liquid transfer cloth are straight grains, curved grains, or grains formed by at least one of the straight grains and the curved grains.

Preferably, at least part of the grains on the vertical-grain liquid transfer cloth extends from top to bottom, and at least part of the grains on the horizontal-grain liquid transfer cloth extends from one end to the other end.

Preferably, the grains on the vertical-grain liquid transfer cloth are matched in shape with at least part of the heating element.

Preferably, 1-6 layers of horizontal-grain liquid transfer cloth are arranged, and at least part of the grains on each of the layers of horizontal-grain liquid transfer cloth correspond to each other in a radial direction; or, at least part of the grains on the adjacent layers of horizontal-grain liquid transfer cloth are staggered in the radial direction.

Preferably, the grains on the horizontal-grain liquid transfer cloth are radial from a centre as the liquid transfer hole to two sides; or, a density of the grains on the horizontal-grain liquid transfer cloth in the vicinity of the liquid transfer hole is greater than that of the grains in other positions; or, the grains on the horizontal-grain liquid transfer cloth are arranged horizontally and uniformly.

Preferably, the atomization core housing is a cylindrical structure.

Preferably, a vertical slot is formed in a side wall of the atomization core housing, and two horizontal ends of the multiple layers of liquid transfer cloth are clamped in the vertical slot to be fixed.

Preferably, at least two vertical slots are formed in a side wall of the atomization core housing, wherein at least one of two horizontal ends of the multiple layers of liquid transfer cloth is clamped in one said vertical slot; or, the multiple layers of liquid transfer cloth have multiple segments, and ends of every two adjacent said segments are clamped in one said vertical slot to be fixed.

Preferably, the atomization core housing is a cylindrical structure, and two horizontal ends of each of the multiple layers of liquid transfer cloth are connected, such that multiple stacked cylindrical structures are formed; or, two horizontal ends of the multiple layers of liquid transfer cloth are connected to form an integrated cylindrical structure.

Preferably, the vertical-grain liquid transfer cloth is woven from linen-cotton fibres, and the horizontal-grain liquid transfer cloth is woven from spunlace non-woven fibres.

Preferably, a lower portion of the electrode is bent to be attached to an inner wall of the atomization core housing, the fixing member matches the atomization core housing in shape, and the electrode is pressed and fixed by the fixing member; or, the fixing member is an elastic element, and the electrode is pressed and fixed in the atomization core housing by the fixing member.

Preferably, a groove is formed in an outer wall of the fixing member, and the electrode is clamped in the groove and is fixed in the atomization core housing by the fixing member; or, a fixing hole is formed in the fixing member, and the electrode penetrates through the fixing hole to be fixed.

A heating atomization mechanism comprises an atomizer housing. The heating atomization core described above is arranged in the atomizer housing, top and bottom of the atomizer housing are sealed by a top sealing element and a bottom sealing element respectively, a liquid chamber is formed between the heating atomization core and the atomizer housing, and liquid storage cotton for storing electronic cigarette liquid is arranged in the liquid chamber.

A heating atomizer comprises the heating atomization mechanism described above. A guide tube is arranged at a centre of the heating atomization mechanism, the guide tube has an end connected to the heating element of the heating atomization core and another end connected to a mouthpiece such that mist atomized by the heating element is guided into the mouthpiece from the guide tube.

An electronic atomization device comprises the above-described heating atomizer arranged at a top, a power supply device arranged in a middle, and a control device arranged at a bottom. The power supply device is electrically connected to the heating atomizer and the control device.

The invention has the following beneficial effects: according to the heating atomization core, the heating atomization mechanism, the heating atomizer and the electronic atomization device, the vertical-grain liquid transfer cloth is arranged on the inner side, in contact with the heating element, of the liquid transfer unit, the horizontal-grain liquid transfer cloth is arranged on the outer side, in contact with the liquid transfer hole, of the liquid transfer unit, the grains on the vertical-grain liquid transfer cloth form micro-grooves or/and micro-ridges which are arranged vertically on the whole, the grains on the horizontal-grain liquid transfer cloth form micro-grooves or/and micro-ridges which are arranged horizontally on the whole, and the micro-grooves or/and micro-ridges formed by the vertical grains match the circuit structure of the heating element to allow the heating element to be slightly inlaid in the liquid transfer cloth, such that the atomization area is enlarged; the horizontal grains form horizontal micro-grooves or/and micro-ridges, such that capillary gaps are formed in the liquid transfer cloth, the transfer rate of liquid along the micro-grooves or/and micro-ridges is higher than the transfer rate of liquid in other directions, and liquid entering the liquid transfer hole can be better transferred around circumferentially and can be transferred uniformly, thus improving the liquid transfer efficiency and atomization effect, and improving the inhaling experience of users.

BRIEF DESCRIPTION OF THE DRAWINGS

The invention will be further described below in conjunction with accompanying drawings and embodiments. In the drawings.

DESCRIPTION OF THE EMBODIMENTS

Figure 1:
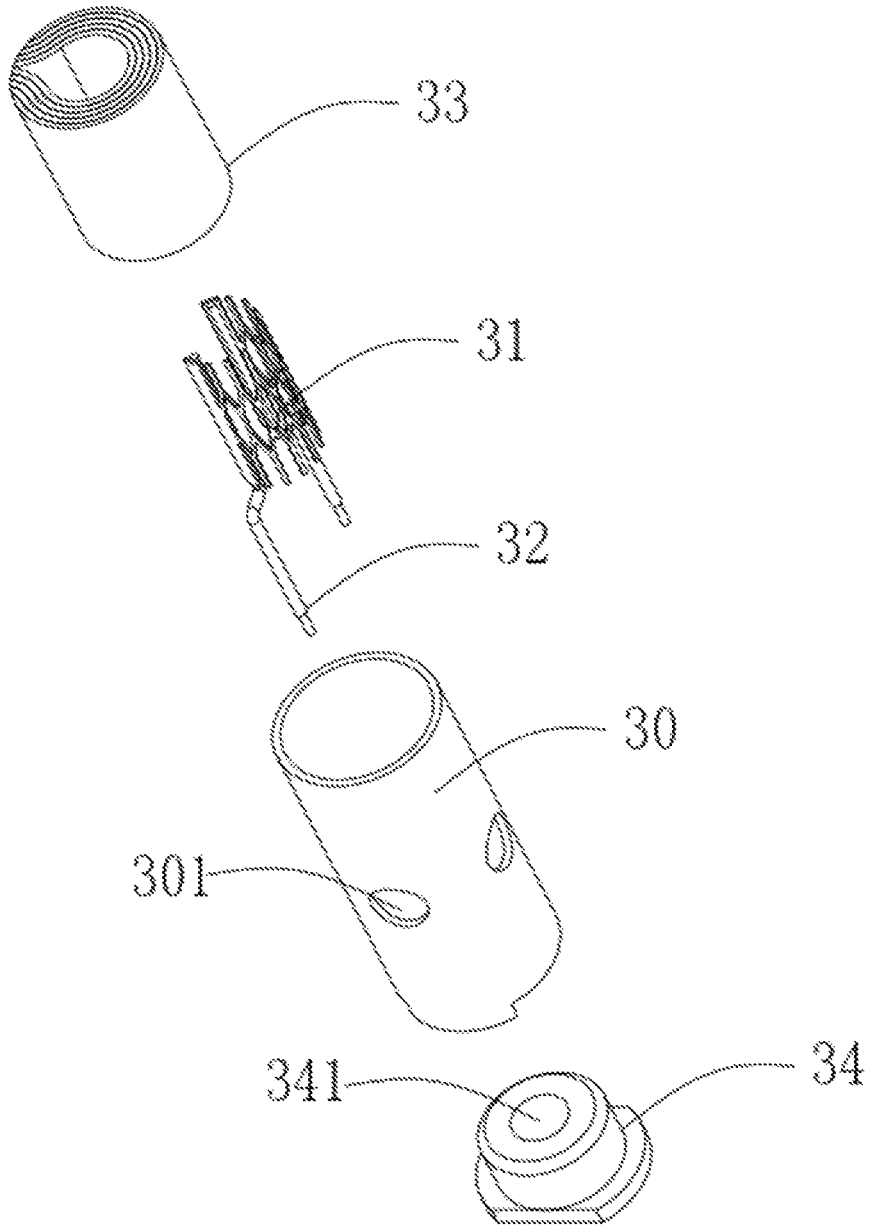
FIG. 1 is an exploded structural view of a first implementation of an atomization core in Embodiment 1 of the invention.

To gain a better understanding of the technical features, purposes and effects of the invention, specific implementations of the invention are described in detail with reference to the accompanying drawings.

When one element is referred to as being "fixed to" or "arranged on" the other element, it may be directly or indirectly located on the other element. When one element is referred to as being "connected to" the other element, it is directly or indirectly connected to the other element.

Terms such as "upper", "lower", "left", "right", "front", "back", "vertical", "horizontal", "top", "bottom", "inner" and "outer" are used for indicating directions or positions based on the accompanying drawings merely for the purpose of description, and should not be construed as limitations of the technical solutions of the invention. Terms such as "first" and "second" are merely for the purpose of facilitating description, and should not be construed as indicating or implying relative importance or implicitly indicating the number of technical features referred to. Unless other expressly and specifically stated, "multiple" refers to two or more.

Embodiment 1: As shown in FIG. 1-FIG. 7, a heating atomization core comprises an atomization core housing 30 in which a cylindrical liquid transfer unit 33 is arranged. A heating element 31 is attached to an inner wall of the liquid transfer unit 33 and connected to an electrode 32. One or more liquid transfer holes 301 for transferring liquid into the liquid transfer unit 33 are formed in a side wall of the atomization core housing 30, and the number of the liquid transfer holes 301 is not limited. The liquid transfer unit 33 is a cylindrical structure formed by rolling multiple layers of liquid transfer cloth in a stacked manner, the multiple layers of liquid transfer cloth comprise at least two layers of vertical-grain liquid transfer cloth 332, or comprise at least two layers of horizontal-grain liquid transfer cloth 331, or comprise at least one layer of vertical-grain liquid transfer cloth 332 and at least one layer of horizontal-grain liquid transfer cloth 331, the invention has no limitation to the stacking position of the horizontal-grain liquid transfer cloth 331 and the vertical-grain liquid transfer cloth 332, and one of the horizontal-grain liquid transfer cloth 331 and the vertical-grain liquid transfer cloth 332 may be arranged on the innermost side to be in closely contact with the heating element 31, or may be arranged in the middle, or may be arranged on the outermost side to be in contact with the liquid transfer hole 301. Each of the multiple layers of liquid transfer cloth may be the horizontal-grain liquid transfer cloth 331, or each of the multiple layers of liquid transfer cloth may be the vertical-grain liquid transfer cloth, or the multiple layers of liquid transfer cloth comprise both the horizontal-grain liquid transfer cloth 331 and the vertical-grain liquid transfer cloth 332. Preferably, the vertical-grain liquid transfer cloth 332 is arranged on the inner side to be attached to and in contact with the heating element 31, and the horizontal-grain liquid transfer cloth 331 is arranged on the outer side to be in contact with the liquid transfer hole 301. The vertical-grain liquid transfer cloth 332 has micro-grooves or/and micro-ridges formed by grains which are arranged vertically on the whole, the horizontal-grain liquid transfer cloth 331 has micro-grooves or/and micro-ridges formed by grains which are arranged horizontally on the whole; and a fixing member 34 for fixing the electrode 32 is arranged in the atomization core housing 30 below the liquid transfer unit 33, and an air inlet 341 is formed in the fixing member 34. When the heating atomization core is used, liquid enters the liquid transfer unit 33 through the liquid transfer hole 301 in the side wall of the atomization core housing 30, flows into the horizontal-grain liquid transfer cloth 331 on the outer side of the liquid transfer unit 33, and then flows circumferentially along the horizontal micro-ridges or/and micro-grooves and infiltrates into the vertical-grain liquid transfer cloth 332 on the inner side. The heating element 31 is inlaid in the micro-grooves or/and between the micro-ridges on the vertical-grain liquid transfer cloth 332. The electrode 32 supplies power to the heating element 31 such that the heating element 31 generates heat to atomize the cigarette liquid in the liquid transfer unit 33 into steam, and at this moment, the steam is carried into an airflow passage by air flowing in through the air inlet 341 and is finally inhaled by users.

As shown in FIG. 15-FIG. 18, the grains of the vertical-grain liquid transfer cloth 332 are arranged vertically on the whole, which means that the grains of the vertical-grain liquid transfer cloth 332 as a whole extend from top to bottom, but this does not require each and every one of the grains to extend from top to bottom; the vertical-grain liquid transfer cloth 332 can also have branching grains extending outward from vertical grains, or vertical grains and horizontal grains may be arranged in a staggered manner. The micro-grooves or/and micro-ridges formed by the grains, which are arranged vertically on the whole, of the vertical-grain liquid transfer cloth 332 may be used as vertical mounting channels where vertical segments of a heating circuit of the heating element 31 can be slightly inlaid, such that the contact area between the heating element 31 and the liquid transfer unit 33 is enlarged. As shown in FIG. 8-FIG. 14, the grains of the horizontal-grain liquid transfer cloth 331 are arranged horizontally on the whole, which means that the grains of the horizontal-grain liquid transfer cloth 331 as a whole extend from left to right, but this does not require each and every one of the grains extend from left to right; the horizontal-grain liquid transfer cloth 331 can also have branching grains extending outward from horizontal grains, or vertical grains and horizontal grains may be arranged in a staggered manner. The micro-grooves or/and micro-ridges formed by the grains, which are arranged horizontally on the whole, of the horizontal-grain liquid transfer cloth 331 form capillary gaps used as horizontal liquid transfer channels, and the rate of liquid transfer along the micro-ridges or/and micro-grooves is higher than the rate of liquid transfer in other directions, such that liquid can be better transferred around and can be transferred uniformly, thus improving the liquid transfer efficiency and atomization effect, and also improving the inhaling experience of users.

The heating element 31 may be a heating piece made from metal, and the heating piece is rolled into a cylinder to be attached to the inner wall of the liquid transfer unit. Generally, the heating element 31 is made of alloy with a high electrical resistivity, such as stainless steel alloy, nickel-chromium alloy, ferrum-chromium-aluminium alloy or nickel-ferrum alloy. The thickness of the heating element 31 may be 0.03-0.2 mm, and the invention has no limitation in this aspect. The heating circuit and the electrode 32 may be formed by a cutting or corrosion process, and a lead of the electrode 32 is configured for contacting with an external electrode 32. An end, extending to the outside, of the lead of the electrode 32 is preferably wrapped with insulation skin, and the lead may be made from pure nickel or be a copper wire with the surface plated with sliver. In addition, the fixing member 34 is arranged to fix the lead of the electrode 32, such that poor contact between the heating element 31 and the liquid transfer unit 33 caused by movements of the heating element 31 when the lead extending to the outside is stressed is avoided.

1-6 layers of vertical-grain liquid transfer cloth 332 are arranged, and the specific number of the layers of vertical-grain liquid transfer cloth 332 is not limited. Multiple layers of vertical-grain liquid transfer cloth 332 are stacked in the following manner: at least part of the grains on the multiple layers of vertical-grain liquid transfer cloth 332 correspond to each other in a radial direction, which means that the vertical grains on the multiple layers of vertical-grain liquid transfer cloth 332 correspond to each other in shape and position, and are identical or basically identical in size, such that the heating circuit of the heating element 31 is at least partially inlaid in the micro-grooves or between the adjacent micro-ridges formed by the grains; the term "correspond" used herein can be understood to mean partial or total correspondence; this can enlarge the contact area between the heating element 31 and the vertical-grain liquid transfer cloth 332 (the atomization area of an atomization surface), such that cigarette liquid in the liquid transfer unit 33 can be atomized to a greater extent, thus improving the atomization effect.

Figure 8:
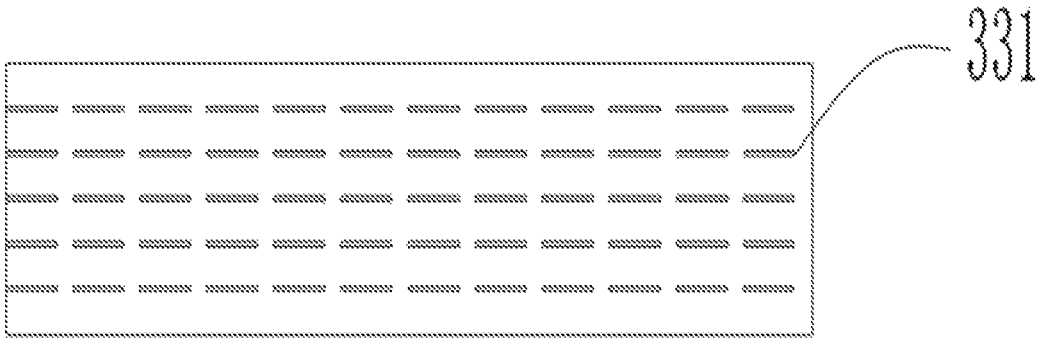
FIG. 8-FIG. 14 are unfolded views of horizontal-grain liquid transfer cloth according to embodiments of the invention.
Figure 9:
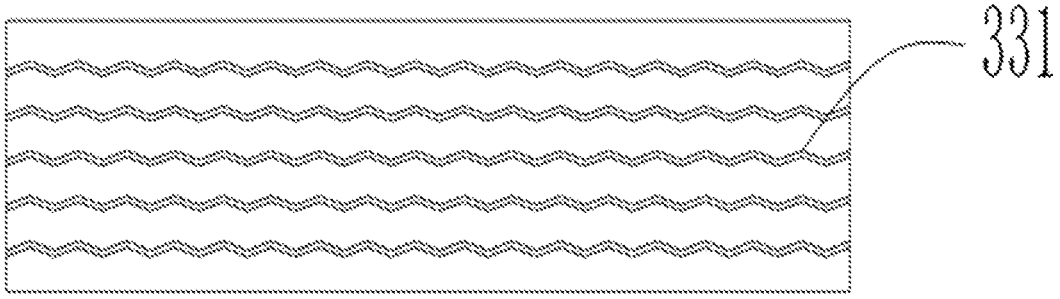
Figure 10:
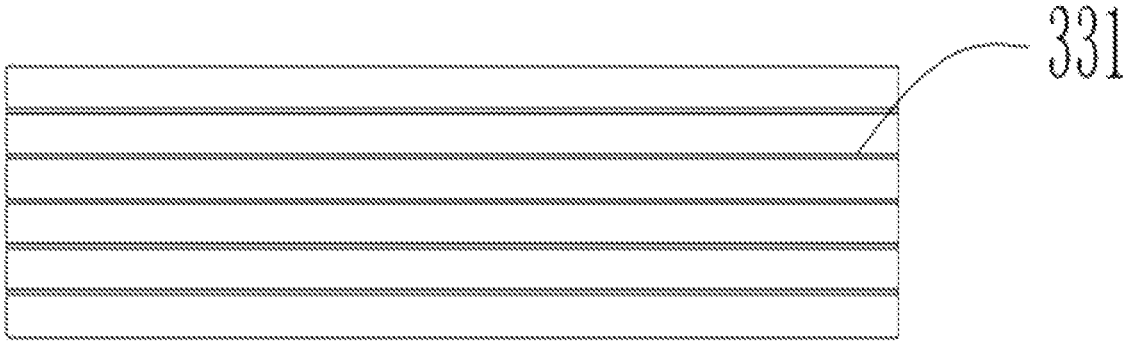
Figure 11:
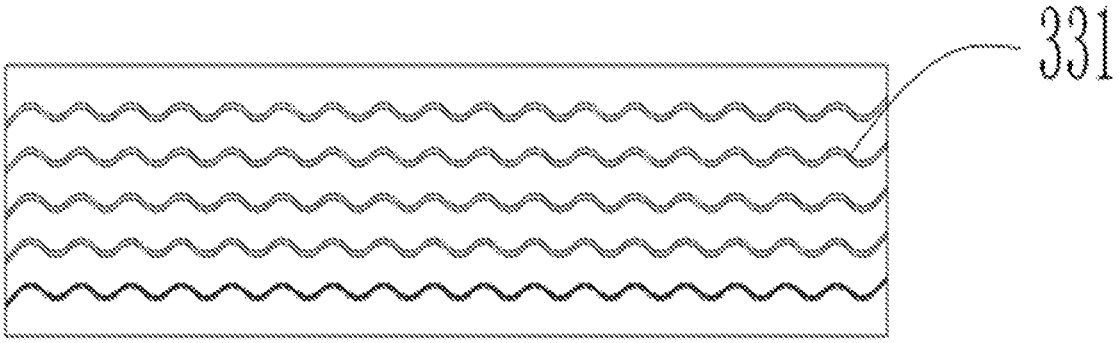
Figure 12:
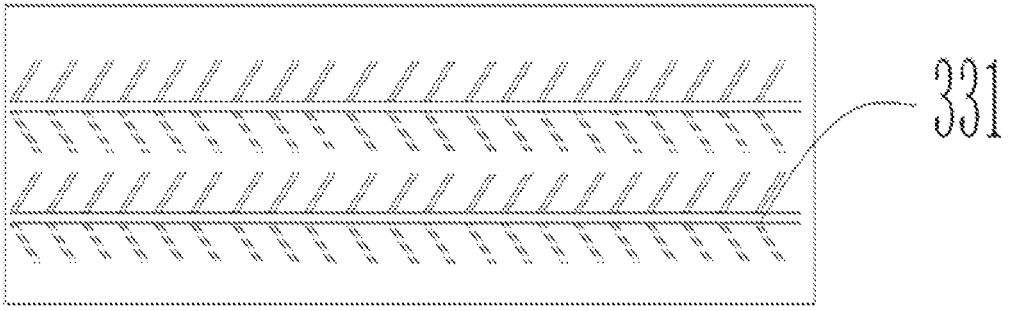
Figure 13:
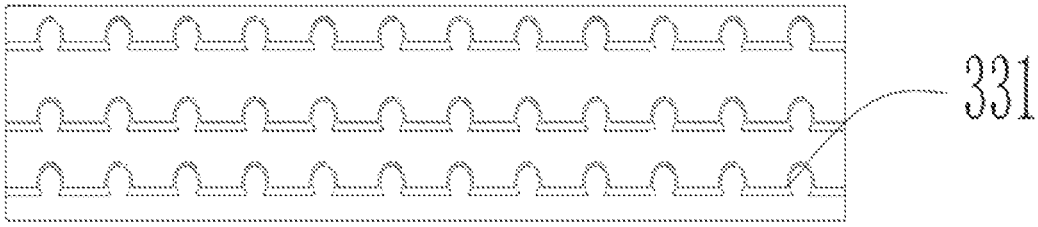
Figure 14:
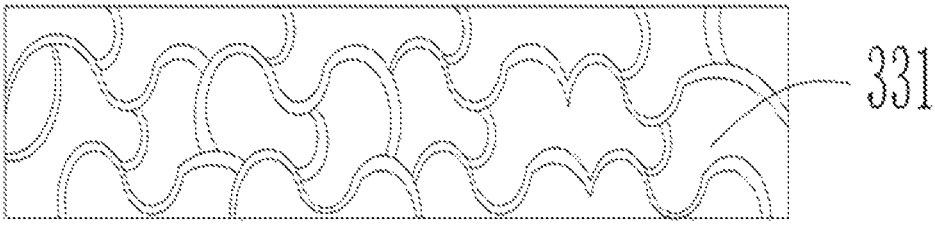
Figure 15:
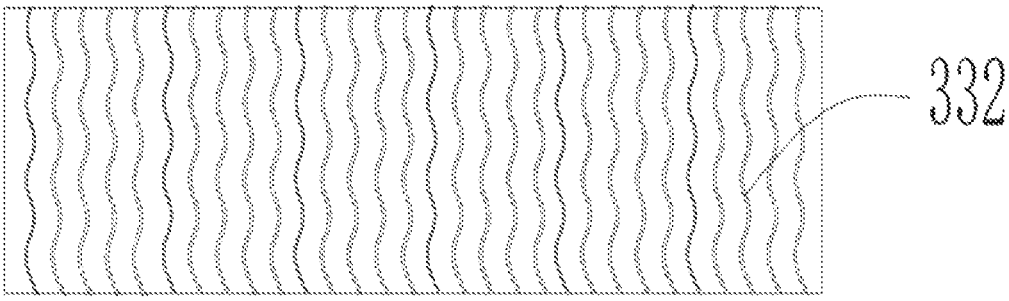
FIG. 15-FIG. 18 are unfolded views of vertical-grain liquid transfer cloth according to embodiments of the invention.
Figure 16:
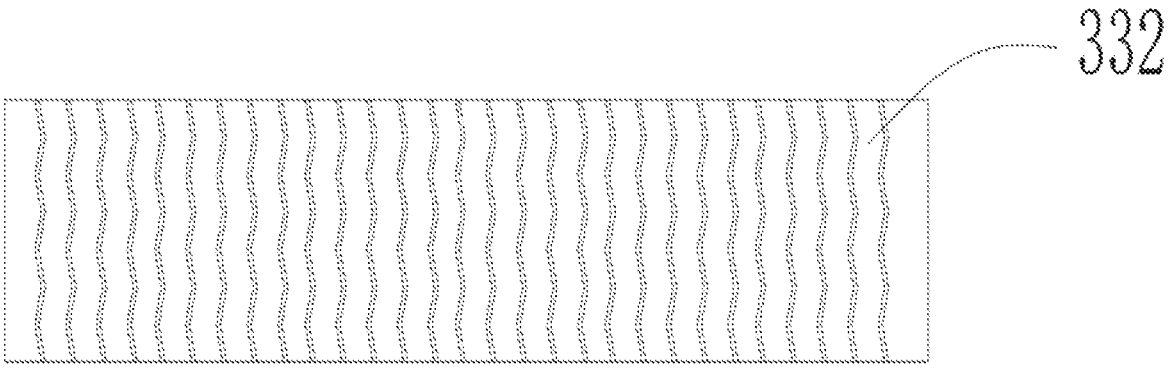
Figure 17:
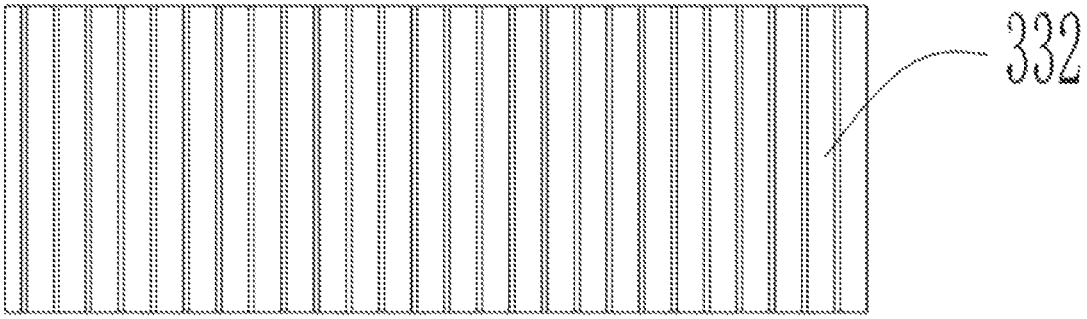
Figure 18:
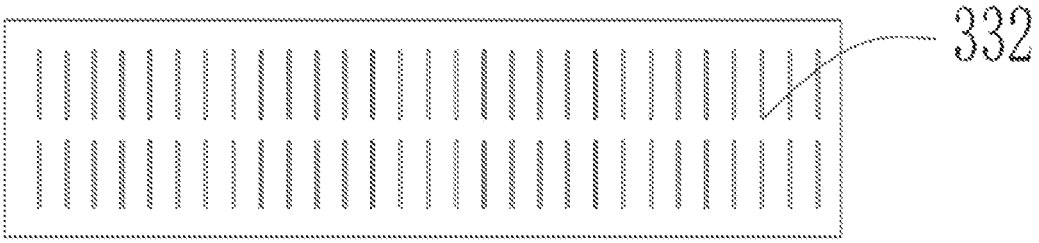

In some embodiments, there are many implementations of the arrangement of the grains on the vertical-grain liquid transfer cloth 332 and on the horizontal-grain liquid transfer cloth 331. As shown in FIG. 8-FIG. 19, the grains on the vertical-grain liquid transfer cloth 332 and on the horizontal-grain liquid transfer cloth 331 are straight grains, curved grains, or grains formed by at least one of the straight grains and the curved grains. The grains on the vertical-grain liquid transfer cloth 332 and on the horizontal-grain liquid transfer cloth 331 may be straight grains which are arranged regularly and uniformly as shown in FIG. 10 and FIG. 17, or irregular branched grains formed by straight lines as shown in FIG. 12, or zigzag grains formed by straight lines as shown in FIG. 9 and FIG. 16. The grains are not definitely straight grains, and may be wavy grains formed by curved lines as shown in FIG. 11, or grains formed by straight lines and curved lines as shown in FIG. 13. The grains are not definitely continuous grains, and may be strip-shaped grains distributed at intervals as shown in FIG. 8 and FIG. 18, criss-crossed curved grains as shown in FIG. 14, or criss-crossed straight grains. Compared with straight grains, the zigzag grains and the curved grains can provide more liquid storage space to ensure sufficient liquid supply when users inhale continuously. In actual application, the shape and arrangement of the grains are not specifically limited as long as the direction of the grains satisfies the design principle that the grains on the liquid transfer cloth in contact with the heating element 31 are vertical on the whole and the grains on the liquid transfer cloth in contact with the liquid transfer hole 301 are horizontal on the whole.

There are many implementations of the arrangement of the grains on the vertical-grain liquid transfer cloth 332 and on the horizontal-grain liquid transfer cloth 331. At least part of the grains on the vertical-grain liquid transfer cloth 332 extend from top to bottom, and at least part of grains on the horizontal-grain liquid transfer cloth 331 extend from one end to the other end. The vertical grains are formed on the vertical-grain liquid transfer cloth 332 such that micro-ridges or micro-grooves that come into close contact with vertical segments of the heating circuit of the heating element 31 can be formed on the vertical-grain liquid transfer cloth 332, thereby enlarging the contact area between the heating element 31 and the vertical-grain liquid transfer cloth 332. At least part of the grains on the vertical-grain liquid transfer cloth 332 extend from top to bottom, and the other grains on the vertical-grain liquid transfer cloth 332 can be horizontal or sloping; or, all the grains on the vertical-grain liquid transfer cloth 332 extend from top to bottom.

In some embodiments, the grains on the vertical-grain liquid transfer cloth 332 are identical in shape with at least part of the heating element 31, that is, at least part of the heating element 31 is inlaid in the micro-grooves or between the adjacent micro-ridges formed by the grains, such that the atomization area between the heating element 31 and the vertical-grain liquid transfer cloth 332 is enlarged.

In some embodiments, 1-6 layers of horizontal-grain liquid transfer cloth 331 are arranged, and multiple layers of horizontal-grain liquid transfer cloth 331 are stacked in the following manner: at least part of the grains on the multiple layers of horizontal-grain liquid transfer cloth 331 correspond to each other in the radial direction, which means that the horizontal grains on the multiple layers of horizontal-grain liquid transfer cloth 331 correspond to each other in shape and position, and are identical or basically identical in size; the term "correspond" used herein can be understood to mean partial or total correspondence; or at least part of the grains on the adjacent layers of horizontal-grain liquid transfer cloth 331 are staggered in the radial direction, which means that the micro-grooves or micro-ridges formed by the horizontal grains on the adjacent layers of horizontal-grain liquid transfer cloth 331 are staggered in position, that is, the micro-ridges of the horizontal grains or protrusions that form the micro-grooves of the horizontal grains on one layer of horizontal-grain liquid transfer cloth 331 are engagingly received in recesses formed by the micro-ridges of the horizontal grains or in the micro-grooves of the horizontal grains on the adjacent layer of horizontal-grain liquid transfer cloth 331, such that the liquid transfer rate is increased; wherein, the grains can be staggered partially or entirely.

In some embodiments, the horizontal grains on the horizontal-grain liquid transfer cloth 331 and the vertical grains on the vertical-grain liquid transfer cloth 332 can be understood as micro-ridges or micro-grooves on the surface of the liquid transfer cloth. The width of the micro-grooves or micro-ridges on each layer of liquid transfer cloth is less than 0.5 mm, and the depth of the micro-grooves or micro-ridges on each layer of liquid transfer cloth is less than 0.1 mm. By controlling the height and spacing distance of the micro-ridges or micro-grooves to control the amount of liquid storage, the liquid transfer unit 33 will be saturated after absorbing liquid to some extent and will not be oversaturated, thus preventing liquid from overflowing out of the liquid transfer unit 33, which may otherwise compromise the atomization effect.

In some embodiments, the grains on the horizontal-grain liquid transfer cloth 331 are radial from the centre as the liquid transfer hole 301 to two sides, such that liquid entering the liquid transfer hole 301 can be quickly transferred circumferentially along the two sides after entering the liquid transfer cloth; or, the density of the grains on the horizontal-grain liquid transfer cloth 331 in the vicinity of the liquid transfer hole 301 is greater than the density of the grains in other positions, such that liquid entering the liquid transfer hole 301 can be transferred around with the liquid transfer hole 301 as the centre point; or, the grains on the horizontal-grain liquid transfer cloth 331 are arranged horizontally and uniformly.

The atomization core housing 30 is a cylindrical structure. Since the liquid transfer unit 33 is cylindrical, the atomization core housing 30 is designed into a cylindrical housing to match the liquid transfer unit 33, such that the liquid transfer unit 33 can be better fixed, and the liquid transfer unit 33 formed by rolling multiple layers of liquid transfer cloth can be fixedly mounted in the atomization core housing 30. In some specific embodiments, in order to save costs, the atomization core housing 30 is formed by cutting a metal tube and is a tubular structure, and the liquid transfer hole 301 allowing liquid to enter is formed in the side wall of the atomization core housing 30.

Figure 2:
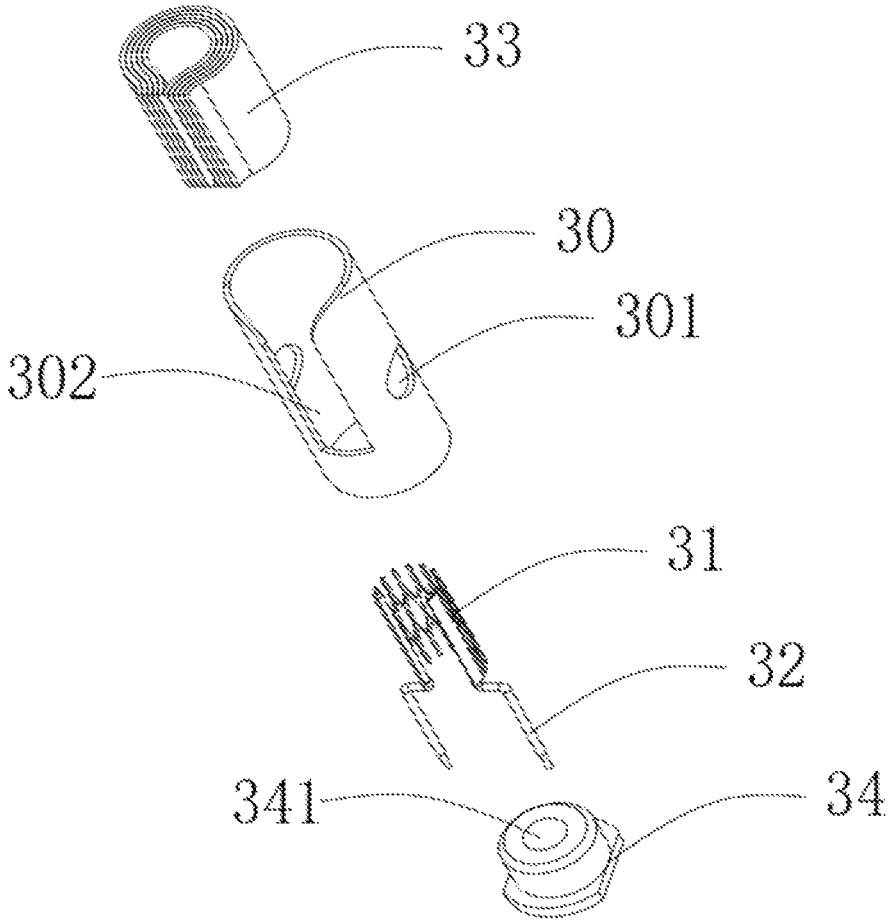
FIG. 2 is an exploded structural view of a second implementation of the atomization core in Embodiment 1 of the invention.
Figure 7:
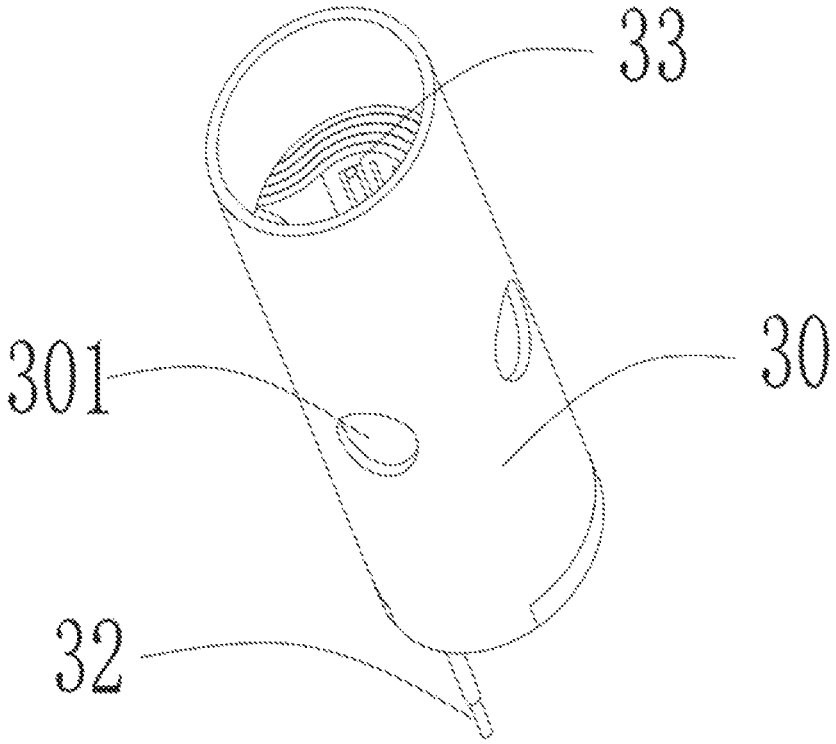
FIG. 7 is a three-dimensional structural view of the atomization core in Embodiment 1 of the invention.

In some embodiments, the atomization core housing 30 may be a tubular metal structure with at least one slot formed in the side wall, such that the liquid transfer unit 33 and the heating element 31 can be installed in the atomization core housing 30 easily. Preferably, a vertical slot 302 is formed in the side wall of the atomization core housing 30, as shown in FIG. 2, an open end of the heating element 31 faces a joint of the two horizontal ends of the multiple layers of stacked and rolled liquid transfer cloth, and the joint of the two horizontal ends of the multiple layers of liquid transfer cloth is exactly clamped in the vertical slot 302 to be fixed, such that the heating circuit of the heating element 31 can be better fit the liquid transfer unit 33, thus improving the atomization effect, and solving the problem that the joint of the two horizontal ends of the multiple layers of rolled liquid transfer cloth cannot well fit the heating element 31. Or, no slot is formed in the side wall of the atomization core housing 30, and as shown in FIG. 1 and FIG. 7, the multiple layers of stacked and rolled liquid transfer cloth are fixed in a cavity of an atomizer.

Figure 3:
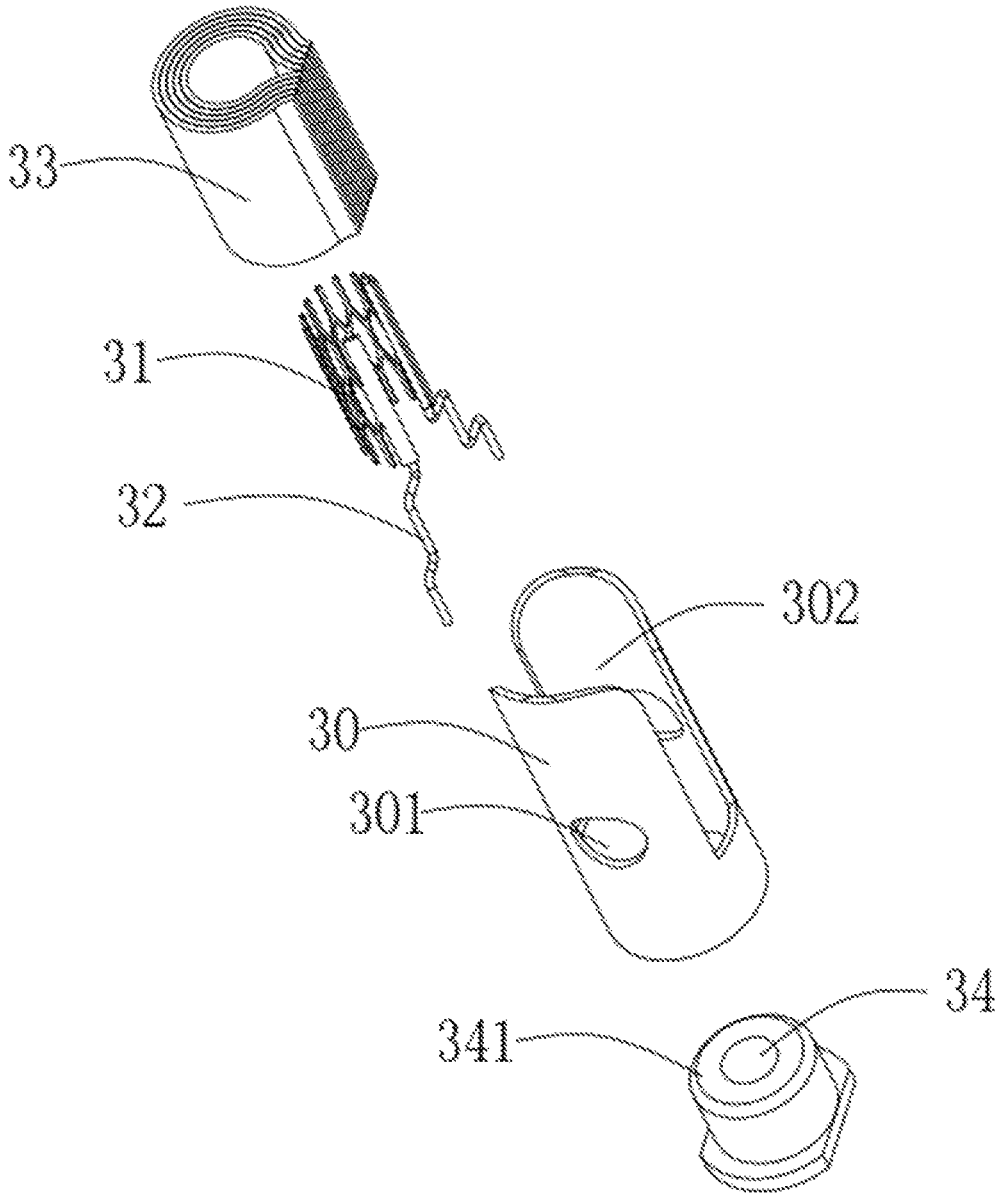
FIG. 3 is an exploded structural view of a third implementation of the atomization core in Embodiment 1 of the invention.
Figure 4:
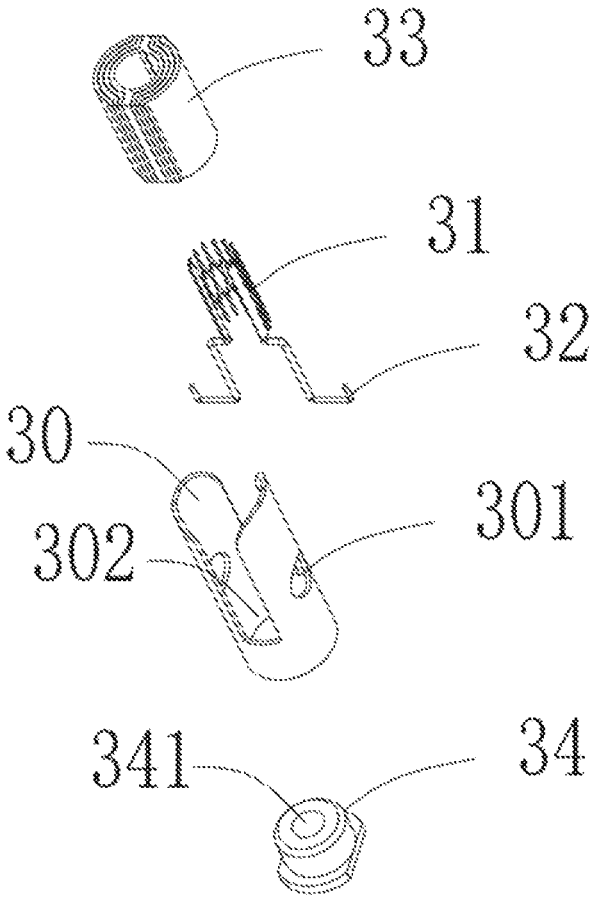
FIG. 4 is an exploded structural view of a fourth implementation of the atomization core in Embodiment 1 of the invention.
Figure 5:
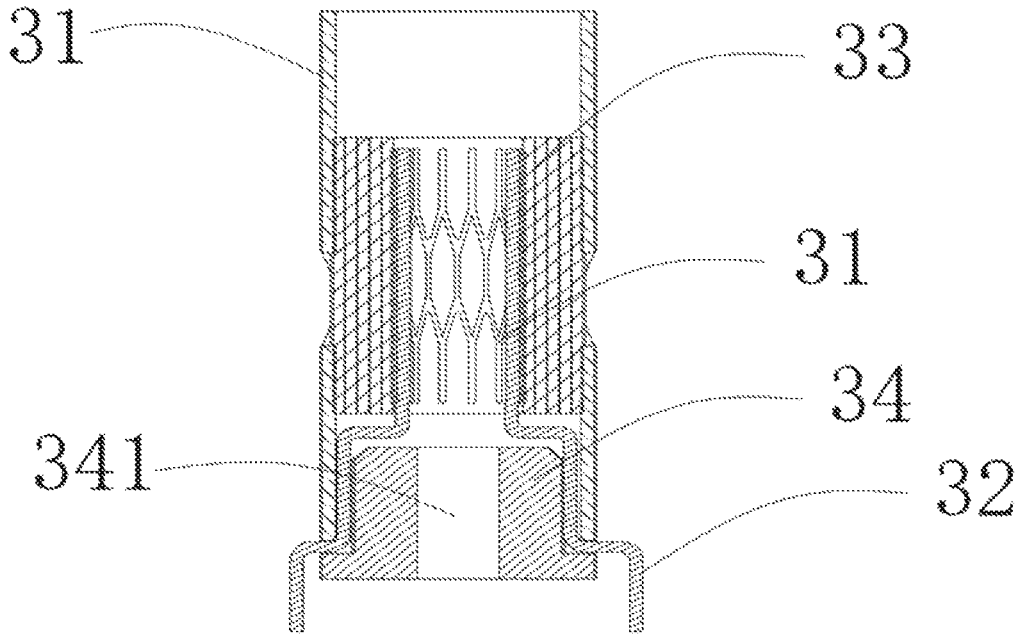
FIG. 5 is a plan sectional view of the atomization core in Embodiment 1 of the invention.
Figure 6:
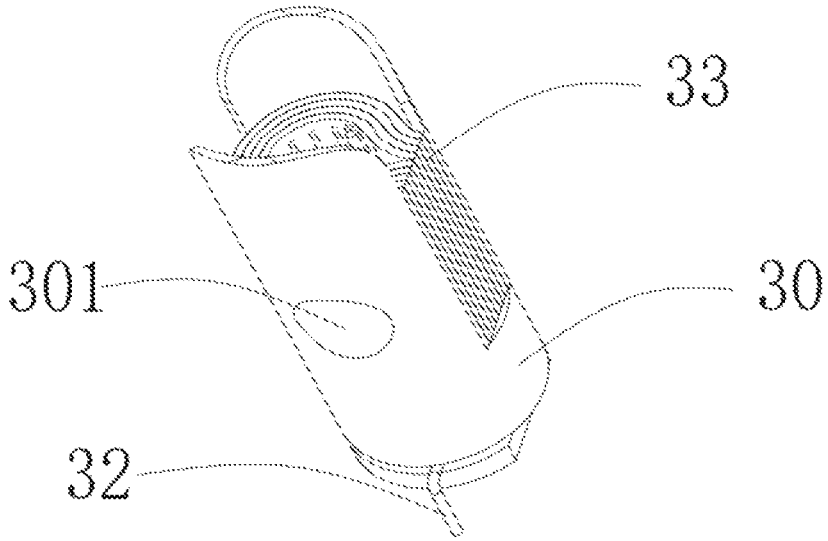
FIG. 6 is a three-dimensional structural view of the atomization core in Embodiment 1 of the invention.

In some embodiments, as shown in FIG. 3 and FIG. 6, at least two vertical slots 302 are formed in the side wall of the atomization core housing 30, and the two horizontal ends of the multiple layers of stacked and rolled liquid transfer cloth are clamped in one vertical slot 302 to be fixed; or, as shown in FIG. 4, the multiple layers of liquid transfer cloth have multiple segments, and the ends which be in the same direction of every two adjacent segments of the multiple layers of liquid transfer cloth are clamped in one vertical slot 302 to be fixed.

In some embodiments, the atomization core housing 30 is cylindrical, and the two horizontal ends of each of the multiple layers of liquid transfer cloth are connected, such that multiple stacked cylindrical structures are formed; or, the two horizontal ends of the multiple layers of liquid transfer cloth are connected to form an integrated cylindrical structure; that is, the cylindrical liquid transfer unit 33 is fixed in the cavity of the cylindrical atomization core housing 30.

In some embodiments, the vertical-grain liquid transfer cloth 332 is woven from linen-cotton fibres, and the horizontal-grain liquid transfer cloth 331 is woven from spunlace non-woven fibres. The vertical-grain liquid transfer cloth 332 woven from the linen-cotton fibres can withstand high temperature, is unlikely to be carbonized when in contact with the heating element 31, and has a longer service life, and the vertical grains matching the heating circuit of the heating element 31 allow the heating element 31 to be slightly inlaid in the vertical-grain liquid transfer cloth 332, such that the contact area between the heating element 31 and the liquid transfer cloth 332 is enlarged. Because the non-woven fibres have good liquid transfer performance, the horizontal-grain liquid transfer cloth 331 woven from the non-woven fibres can transfer liquid to the heating element 31 on the inner side more quickly when arranged on the outer side, and the horizontal grains form horizontal micro-grooves or micro-ridges, which in turn form large capillary gaps on the horizontal-grain liquid transfer cloth 331, and the rate of liquid transfer along the micro-grooves is higher than the rate of liquid transfer in other directions, such that liquid entering the liquid transfer hole 301 can be better transferred circumferentially, and liquid can flow into the cylindrical liquid transfer unit 33 uniformly.

In some embodiments, a lower portion of the electrode 32 is bent to be attached to an inner wall of the atomization core housing 30, the fixing member 34 matches the atomization core housing 30 in shape, and the electrode 32 is pressed and fixed by the fixing member 34; or, the fixing member 34 is an elastic element, and the electrode 32 is pressed and fixed in the atomization core housing 30 by the fixing member 34.

In some embodiments, a groove is formed in an outer wall of the fixing member 34, the electrode 32 is clamped in the groove, and the fixing member 34 is fixed in the atomization core housing 30; or, a fixing hole is formed in the fixing member 34, and the electrode 32 penetrates through the fixing hole to be fixed.

Figure 19:
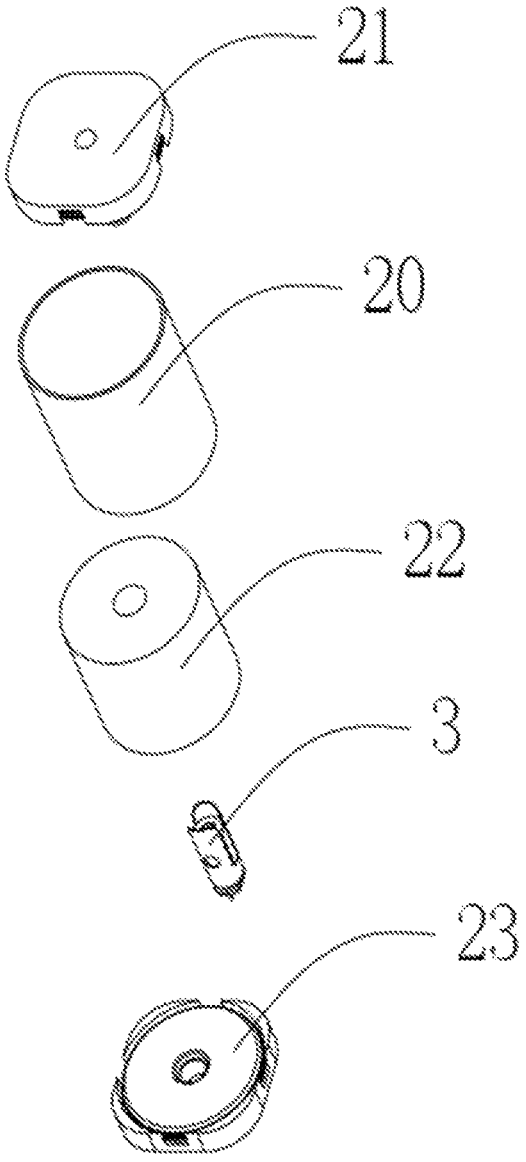
FIG. 19 is an exploded view of a heating atomization mechanism in Embodiment 2 of the invention.

Embodiment 2. In some embodiments, as shown in FIG. 19, a heating atomization mechanism comprises an atomizer housing 20, wherein the heating atomization core in Embodiment 1 is arranged in the atomizer housing 20, the top and bottom of the atomizer housing 20 are sealed by a top sealing element 21 and a bottom sealing element 23 respectively, a liquid chamber is formed between the heating atomization core and the atomizer housing 20, and liquid storage cotton 22 for storing cigarette liquid is arranged in the liquid chamber; the top sealing element 21 and the bottom sealing element 23 arranged on the atomizer housing 20 can prevent the cigarette liquid in the liquid chamber from leaking; and when the heating atomization mechanism is used, the cigarette liquid in the liquid chamber flows towards the liquid transfer holes 301 in the atomizer housing 20 and is transferred to the heating atomization core to be heated and atomized into steam. Other structures of the heating atomization mechanism belong to the prior art, and will not be repeated here.

Figure 20:
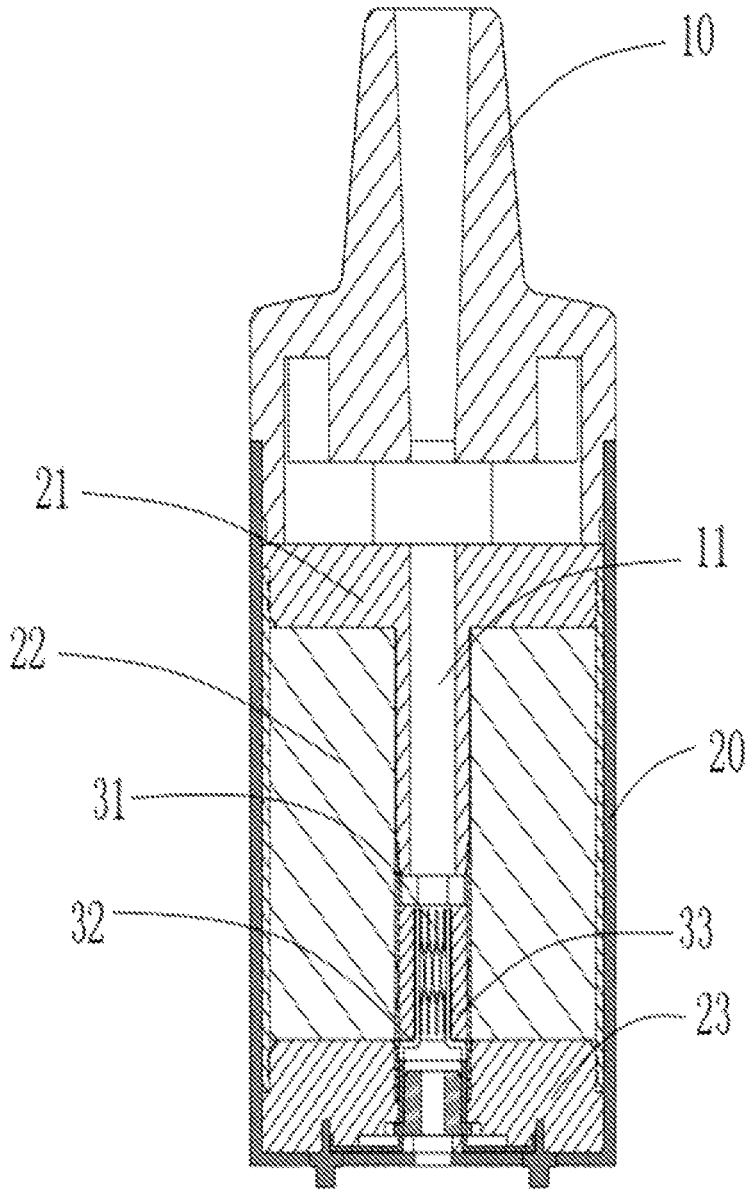
FIG. 20 is a sectional view of a heating atomizer in Embodiment 3 of the invention.

Embodiment 3: As shown in FIG. 20, a heating atomizer comprises the heating atomization mechanism in Embodiment 2, a guide tube 11 is arranged at the centre of the heating atomization mechanism, one end of the guide tube 11 is connected to the heating element 31 of the heating atomization core, the other end of the guide tube 11 is connected to a mouthpiece 10, and mist atomized by the heating element 31 is guided into the mouthpiece 10 from the guide tube 11; and when the heating atomizer is used, cigarette liquid is heated by the heating element 31 to be atomized into steam, which flows to the mouthpiece 10 through the guide tube 11 and is finally inhaled by users. Other structures of the heating atomizer belong to the prior art, and will not be repeated here.

Figure 21:
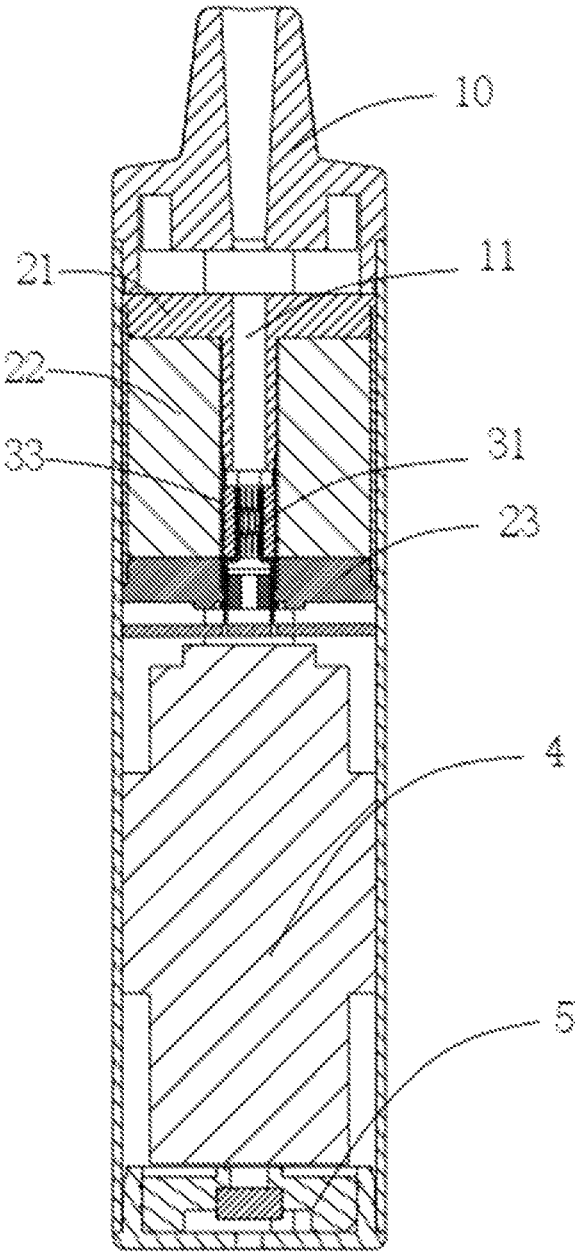
FIG. 21 is a sectional view of an electronic atomization device in Embodiment 4 of the invention.

Embodiment 4: As shown in FIG. 21, an electronic atomization device comprises the heating atomizer in Embodiment 3 at the top, a power supply device 4 in the middle, and a control device 5 at the bottom, wherein the power supply device 4 is electrically connected to the heating atomizer and the control device 5; and when the electronic atomization device is used, the control device 5 is controlled to start the power supply device 4, the power supply device 4 supplies power to the heating atomizer, the heating atomizer atomizes cigarette liquid into steam, and the steam is finally inhaled by users. Other structures of the heating atomization device belong to the prior art, and will not be repeated here.

What is claimed is:

1. A heating atomization core, comprising an atomization core housing (30), wherein a cylindrical liquid transfer unit (33) is arranged in the atomization core housing (30), and a heating element (31) is attached to an inner wall of the liquid transfer unit (33) and is connected to an electrode (32);

a liquid transfer hole (301) for transferring liquid into the liquid transfer unit (33) is formed in a side wall of the atomization core housing (30);

the liquid transfer unit (33) is of a cylindrical structure formed by rolling multiple layers of liquid transfer cloth in a stacked manner, the multiple layers of liquid transfer cloth comprise at least one layer of vertical-grain liquid transfer cloth (332) and at least one layer of horizontal-grain liquid transfer cloth (331), the vertical-grain liquid transfer cloth (332) has micro-grooves or/and micro-ridges formed by grains which are arranged vertically on the whole, and the horizontal-grain liquid transfer cloth (331) has micro-grooves or/and micro-ridges formed by grains which are arranged horizontally on the whole to form capillary gaps;

a fixing member (34) for fixing the electrode (32) is arranged in the atomization core housing (30) below the liquid transfer unit (33), and an air inlet (341) is formed in the fixing member (34);

the at least one layer of vertical-grain liquid transfer cloth (332) is located at an inner side of the liquid transfer unit (33) to allow vertical segments of a heating circuit of the heating element (31) to be at least partially inlaid in the micro-grooves or between adjacent micro-ridges formed by the at least one layer of vertical-grain liquid transfer cloth (332); and the at least one layer of horizontal-grain liquid transfer cloth (331) is located at an outer side of the liquid transfer unit (33) and correspond to the liquid transfer hole (301) in a radial direction of the liquid transfer unit (33).

2. The heating atomization core according to claim 1, wherein 2-6 layers of vertical-grain liquid transfer cloth (332) are arranged, and at least part of the grains on each of the layers of vertical-grain liquid transfer cloth (332) correspond to each other in a radial direction, such that a heating circuit of the heating element (31) is at least partially inlaid in the micro-grooves or between the adjacent micro-ridges formed by the grains.

3. The heating atomization core according to claim 1, wherein the grains on the vertical-grain liquid transfer cloth (332) are straight grains, curved grains, or grains formed by at least one of the straight grains and the curved grains, and the grains on the horizontal-grain liquid transfer cloth (331) are straight grains, curved grains, or grains formed by at least one of the straight grains and the curved grains.

4. The heating atomization core according to claim 1, wherein at least part of the grains on the vertical-grain liquid transfer cloth (332) extends from top to bottom, and at least part of the grains on the horizontal-grain liquid transfer cloth (331) extend from one end to the other end.

5. The heating atomization core according to claim 1, wherein the grains on the vertical-grain liquid transfer cloth (332) are matched in shape with at least part of the heating element (31).

6. The heating atomization core according to claim 1, wherein 2-6 layers of horizontal-grain liquid transfer cloth (331) are arranged, and at least part of the grains on each of the layers of horizontal-grain liquid transfer cloth (331) correspond to each other in a radial direction; or, at least part of the grains on the adjacent layers of horizontal-grain liquid transfer cloth (331) are staggered in the radial direction.

7. The heating atomization core according to claim 1, wherein the grains on the horizontal-grain liquid transfer cloth (331) are radial from a centre as the liquid transfer hole (301) to two sides; or, a density of the grains on the horizontal-grain liquid transfer cloth (331) in the vicinity of the liquid transfer hole (301) is greater than that of the grains in other positions; or, the grains on the horizontal-grain liquid transfer cloth (331) are arranged horizontally and uniformly.

8. The heating atomization core according to claim 1, wherein the atomization core housing (30) is a cylindrical structure.

9. The heating atomization core according to claim 1, wherein a vertical slot (302) is formed in a side wall of the atomization core housing (30), and two horizontal ends of the multiple layers of liquid transfer cloth are clamped in the vertical slot (302) to be fixed.

10. The heating atomization core according to claim 1, wherein at least two vertical slots (302) are formed in a side wall of the atomization core housing (30), wherein at least one of two horizontal ends of the multiple layers of liquid transfer cloth is clamped in one said vertical slot (302); or, the multiple layers of liquid transfer cloth have multiple segments, and ends which be in the same direction of every two adjacent said segments are clamped in one said vertical slot (302) to be fixed.

11. The heating atomization core according to claim 1, wherein the atomization core housing (30) is a cylindrical structure, and two horizontal ends of each of the multiple layers of liquid transfer cloth are connected, such that multiple stacked cylindrical structures are formed; or, two horizontal ends of the multiple layers of liquid transfer cloth are connected to form an integrated cylindrical structure.

12. The heating atomization core according to claim 1, wherein the vertical-grain liquid transfer cloth (332) is woven from linen-cotton fibres, and the horizontal-grain liquid transfer cloth (331) is woven from spunlace non-woven fibres.

13. The heating atomization core according to claim 1, wherein a lower portion of the electrode (32) is bent to be attached to an inner wall of the atomization core housing (30), the fixing member (34) matches the atomization core housing (30) in shape, and the electrode (32) is pressed and fixed by the fixing member (34); or, the fixing member (34) is an elastic element, and the electrode (32) is pressed and fixed in the atomization core housing (30) by the fixing member (34).

14. The heating atomization core according to claim 1, wherein a groove is formed in an outer wall of the fixing member (34), and the electrode (32) is clamped in the groove and is fixed in the atomization core housing (30) by the fixing member (34); or, a fixing hole is formed in the fixing member (34), and the electrode (32) penetrates through the fixing hole to be fixed.

15. A heating atomization mechanism, comprising an atomizer housing (20), wherein the heating atomization core according to claim 1 is arranged in the atomizer housing (20), top and bottom of the atomizer housing (20) are sealed by a top sealing element (21) and a bottom sealing element (23) respectively, a liquid chamber is formed between the heating atomization core and the atomizer housing (20), and liquid storage cotton (22) for storing electronic cigarette liquid is arranged in the liquid chamber.

16. A heating atomizer, comprising the heating atomization mechanism according to claim 15, wherein a guide tube (11) is arranged at a centre of the heating atomization mechanism, the guide tube (11) has an end connected to the heating element (31) of the heating atomization core and another end connected to a mouthpiece (10) such that mist atomized by the heating element (31) is guided into the mouthpiece (10) from the guide tube (11).

17. An electronic atomization device, comprising the heating atomizer according to claim 16 arranged at a top, a power supply device (4) arranged in a middle, and a control device (5) arranged at a bottom, wherein the power supply device (4) is electrically connected to the heating atomizer and the control device (5).

18. The heating atomization mechanism according to claim 15, wherein 2-6 layers of vertical-grain liquid transfer cloth (332) are arranged, and at least part of the grains on each of the layers of vertical-grain liquid transfer cloth (332) correspond to each other in a radial direction, such that a heating circuit of the heating element (31) is at least partially inlaid in the micro-grooves or between the adjacent micro-ridges formed by the grains.

19. The heating atomization mechanism according to claim 15, wherein the grains on the vertical-grain liquid transfer cloth (332) are matched in shape with at least part of the heating element (31), wherein at least part of the grains on the vertical-grain liquid transfer cloth (332) extends from top to bottom, and at least part of the grains on the horizontal-grain liquid transfer cloth (331) extend from one end to the other end.

20. The heating atomization mechanism according to claim 15, wherein 2-6 layers of horizontal-grain liquid transfer cloth (331) are arranged, and at least part of the grains on each of the layers of horizontal-grain liquid transfer cloth (331) correspond to each other in a radial direction; or, at least part of the grains on the adjacent layers of horizontal-grain liquid transfer cloth (331) are staggered in the radial direction.

* * * * *